US008944881B2

(12) United States Patent
Payne

(10) Patent No.: US 8,944,881 B2
(45) Date of Patent: Feb. 3, 2015

(54) TOY TRACK SET

(75) Inventor: Julian R. Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 684 days.

(21) Appl. No.: 13/219,799

(22) Filed: Aug. 29, 2011

(65) Prior Publication Data

US 2012/0052766 A1 Mar. 1, 2012

Related U.S. Application Data

(60) Provisional application No. 61/418,618, filed on Dec. 1, 2010, provisional application No. 61/391,349, filed on Oct. 8, 2010, provisional application No. 61/377,731, filed on Aug. 27, 2010, provisional application No. 61/377,766, filed on Aug. 27, 2010.

(51) Int. Cl.
*A63H 18/00* (2006.01)
*A63H 33/26* (2006.01)
(Continued)

(52) U.S. Cl.
CPC ..... *A63H 18/10* (2013.01); *A63H 18/028* (2013.01)
USPC ..... 446/444; 446/129

(58) Field of Classification Search
CPC ..... A63H 18/00; A63H 18/02; A63H 18/025; A63H 18/028; A63H 18/10; A63H 19/00; A63H 33/26; A63H 33/046
USPC ..... 446/444–446, 129, 137; 104/54; 238/10 E, 10 R, 10 A
See application file for complete search history.

(56) References Cited

U.S. PATENT DOCUMENTS 867,506 A 10/1907 Hermann
1,511,983 A 10/1924 Shea
(Continued)

FOREIGN PATENT DOCUMENTS

EP 0525657 A1 2/1993
GB 2029246 A 3/1980
(Continued)

OTHER PUBLICATIONS

Written Opinion for International Application No. PCT/US2011/049583; Date of Mailing: Apr. 27, 2012.
(Continued)

*Primary Examiner* — Gene Kim
*Assistant Examiner* — Alyssa Hylinski
(74) *Attorney, Agent, or Firm* — Cantor Colburn LLP

(57) ABSTRACT

A toy track set is disclosed herein, the toy track set having: a vehicle path defined by a track and a gap disposed between a pair of ends of the track; a carriage assembly configured to carry a toy vehicle across the gap such that the toy vehicle may travel from one of the pair of ends of the track to another one of the pair of ends of the track on the carriage assembly; a ferromagnetic material disposed in the track; wherein the toy vehicle has at least one magnet disposed on the toy vehicle such that the toy vehicle may travel on the track in anyone of an inverted or vertical fashion; and a release mechanism positioned on the carriage assembly, the release mechanism being configured to engage one of the pair of ends of the track when the release mechanism is in a first position and release the release mechanism from the one of the pair of ends of the track when the release mechanism is moved to a second position from the first position by the toy vehicle travelling onto the carriage assembly; and wherein the carriage assembly slides along a line from the one of the pair of ends of the track to the other one of the pair of ends of the track when the release mechanism is moved to the second position from the first position by the toy vehicle travelling onto the carriage assembly and wherein the toy vehicle travels from the carriage assembly onto the other one of the pair of ends of the track when the carriage assembly contacts the other one of the pair of ends of the track.

19 Claims, 6 Drawing Sheets

(51) Int. Cl.
*A63H 18/10* (2006.01)
*A63H 18/02* (2006.01)

(56) References Cited

U.S. PATENT DOCUMENTS

| | | | | | |
|---|---|---|---|---|---|
| 1,545,676 | A | | 7/1925 | Mantley | |
| 1,551,002 | A | | 8/1925 | Beck | |
| 1,599,982 | A | | 9/1926 | Bauer | |
| 1,997,512 | A | | 4/1935 | Einfalt | |
| 2,746,206 | A | | 5/1956 | Hammond, Jr. | |
| 2,756,687 | A | | 7/1956 | Fields | |
| 3,281,985 | A | | 11/1966 | Einfalt | |
| 3,451,161 | A | * | 6/1969 | Lemelson | 446/138 |
| 3,494,070 | A | | 2/1970 | Lemelson | |
| 3,540,153 | A | | 11/1970 | Aoki | |
| 3,600,849 | A | * | 8/1971 | Faller | 446/429 |
| 3,613,306 | A | | 10/1971 | Arai | |
| 3,626,635 | A | * | 12/1971 | Birdsall | 446/136 |
| 3,633,308 | A | | 1/1972 | Yang | |
| 3,690,393 | A | * | 9/1972 | Guy | 180/65.6 |
| 3,693,290 | A | | 9/1972 | Breslow et al. | |
| 3,721,036 | A | | 3/1973 | Goldfarb | |
| 3,858,875 | A | | 1/1975 | Nemeth et al. | |
| 3,860,238 | A | | 1/1975 | Kojima | |
| 3,955,429 | A | | 5/1976 | Holden | |
| 4,031,661 | A | | 6/1977 | Bernhard | |
| 4,045,908 | A | * | 9/1977 | Ensmann et al. | 446/441 |
| 4,051,624 | A | | 10/1977 | Ogawa | |
| 4,068,402 | A | | 1/1978 | Tanaka | |
| 4,128,964 | A | | 12/1978 | Ogasawara | |
| 4,221,076 | A | | 9/1980 | Ozawa | |
| 4,222,195 | A | | 9/1980 | Kurosawa et al. | |
| 4,237,648 | A | | 12/1980 | Moe et al. | |
| 4,249,733 | A | | 2/1981 | Eddins et al. | |
| 4,254,576 | A | * | 3/1981 | Matsumoto et al. | 446/444 |
| 4,306,375 | A | | 12/1981 | Goldfarb et al. | |
| 4,312,149 | A | | 1/1982 | Iwao | |
| 4,357,778 | A | | 11/1982 | Matsumoto et al. | |
| 4,386,777 | A | | 6/1983 | Prehodka | |
| 4,394,961 | A | | 7/1983 | Muller | |
| 4,429,488 | A | | 2/1984 | Wessels | |
| 4,438,590 | A | | 3/1984 | Lee | |
| 4,443,967 | A | | 4/1984 | Jones et al. | |
| 4,475,305 | A | | 10/1984 | Kawakami et al. | |
| 4,492,058 | A | | 1/1985 | Goldfarb et al. | |
| 4,496,330 | A | | 1/1985 | Terui | |
| 4,547,174 | A | | 10/1985 | Lee et al. | |
| RE32,106 | E | * | 4/1986 | Lemelson | 446/138 |
| 4,609,363 | A | | 9/1986 | Udagawa | |
| 4,678,449 | A | * | 7/1987 | Udagawa | 446/136 |
| 4,708,685 | A | | 11/1987 | Udagawa | |
| 4,767,376 | A | | 8/1988 | Hanzawa | |
| 4,940,444 | A | | 7/1990 | Russell | |
| 4,990,117 | A | | 2/1991 | Yonezawa | |
| 5,038,685 | A | * | 8/1991 | Yoneda et al. | 104/54 |
| 5,279,871 | A | | 1/1994 | Segan et al. | |
| 5,342,048 | A | | 8/1994 | Jones et al. | |
| 5,441,435 | A | | 8/1995 | Shiraishi | |
| 5,452,893 | A | | 9/1995 | Faulk et al. | |
| 5,678,489 | A | | 10/1997 | Wang | |
| 5,785,573 | A | | 7/1998 | Rothbarth et al. | |
| 5,855,501 | A | | 1/1999 | Kato et al. | |
| 5,890,945 | A | | 4/1999 | Asami et al. | |
| 5,899,789 | A | | 5/1999 | Rehkemper et al. | |
| 5,931,714 | A | | 8/1999 | Johnson | |
| 5,951,357 | A | | 9/1999 | Mandle et al. | |
| 6,083,078 | A | | 7/2000 | Yang | |
| 6,173,654 | B1 | * | 1/2001 | Ngai | 104/295 |
| 6,241,573 | B1 | | 6/2001 | Ostendorff et al. | |
| 6,341,564 | B1 | * | 1/2002 | Ochi | 104/53 |
| 6,358,112 | B1 | | 3/2002 | Lambert et al. | |
| 6,422,151 | B2 | | 7/2002 | Maleika | |
| 6,450,857 | B1 | | 9/2002 | Watanabe | |
| 6,478,654 | B1 | | 11/2002 | Rehkemper et al. | |
| 6,508,179 | B2 | | 1/2003 | Annis et al. | |
| 6,676,480 | B2 | | 1/2004 | Sheltman | |
| 7,285,034 | B2 | | 10/2007 | Kay et al. | |
| 7,517,272 | B2 | * | 4/2009 | Bedford et al. | 446/444 |
| 7,537,509 | B2 | | 5/2009 | Payne et al. | |
| 7,549,906 | B2 | * | 6/2009 | Bedford et al. | 446/444 |
| 7,614,931 | B2 | | 11/2009 | Nuttall | |
| 7,628,673 | B2 | | 12/2009 | Bedford et al. | |
| 7,722,427 | B2 | | 5/2010 | Yamana | |
| 8,011,994 | B2 | | 9/2011 | Fink et al. | |
| 2003/0224697 | A1 | | 12/2003 | Sheltman et al. | |
| 2005/0287915 | A1 | | 12/2005 | Sheltman et al. | |
| 2005/0287916 | A1 | | 12/2005 | Sheltman et al. | |
| 2005/0287918 | A1 | | 12/2005 | Sheltman et al. | |
| 2005/0287919 | A1 | | 12/2005 | Sheltman et al. | |
| 2006/0286896 | A1 | | 12/2006 | Bedford et al. | |
| 2006/0286897 | A1 | | 12/2006 | Bedford et al. | |
| 2007/0197127 | A1 | | 8/2007 | Ostendorff et al. | |
| 2007/0209543 | A1 | | 9/2007 | Beaulieu et al. | |
| 2008/0020675 | A1 | | 1/2008 | Ostendorff | |
| 2008/0064295 | A1 | | 3/2008 | Abrams | |
| 2008/0146115 | A1 | | 6/2008 | Yamana | |
| 2008/0171491 | A1 | | 7/2008 | Sheltman | |
| 2008/0248716 | A1 | | 10/2008 | Shackelford et al. | |
| 2009/0075558 | A1 | | 3/2009 | Ostendorff | |
| 2009/0130946 | A1 | | 5/2009 | Fink et al. | |
| 2009/0241798 | A1 | | 10/2009 | Ngai | |

FOREIGN PATENT DOCUMENTS

| | | | |
|---|---|---|---|
| GB | 2049446 | A | 12/1980 |
| GB | 2123704 | A | 2/1984 |
| GB | 2187649 | A | 9/1987 |
| GB | 2198655 | A | 6/1988 |
| JP | 2004-194920 | A | 7/2004 |
| JP | 2009-297473 | A | 12/2009 |
| WO | 99/49948 | | 10/1999 |
| WO | 01/58556 | A1 | 8/2001 |

OTHER PUBLICATIONS

International Search Report for International Application No. PCT/US2011/049683; Date of Mailing: Apr. 27, 2012.
International Search Report for International Application No. PCT/US2011/049581; Date of Mailing: Apr. 27, 2012.
Written Opinion for International Application No. PCT/US2011/049581; Date of Mailing: Apr. 27, 2012.

* cited by examiner

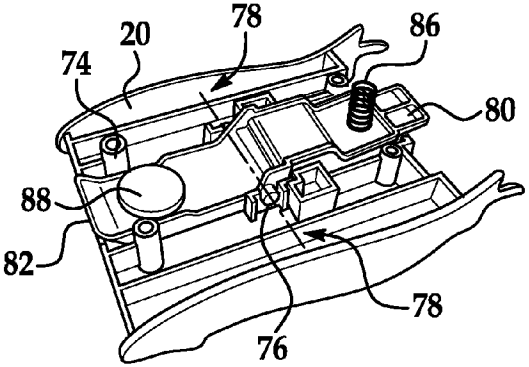
FIG. 6A
FIG. 6B
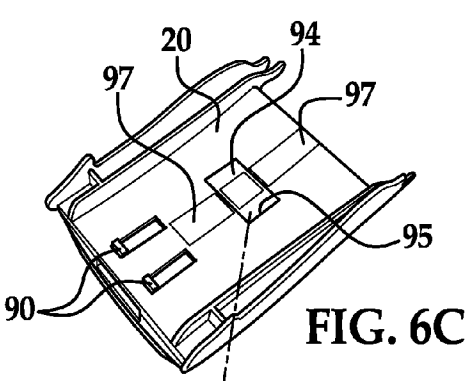
FIG. 6C
FIG. 6E
FIG. 6F
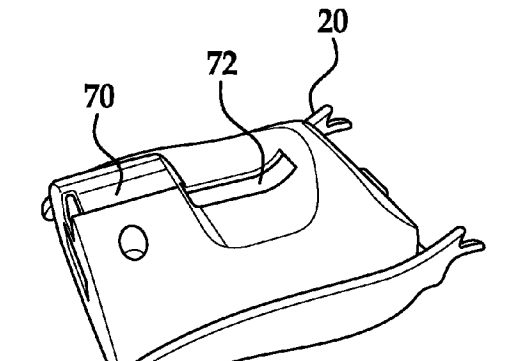
FIG. 6D

TOY TRACK SET

CROSS REFERENCE TO RELATED APPLICATIONS

This application claims the benefit of the following U.S. Provisional Patent Application Ser. Nos. 61/377,731 and 61/377,766 each filed on Aug. 27, 2010; 61/391,349 filed on Oct. 8, 2010; and 61/418,618 filed on Dec. 1, 2010, the contents each of which are incorporated herein by reference thereto.

BACKGROUND

Various embodiments of the present invention are related to toys in particular, a track set for toy vehicles to travel on.

Toy vehicle track sets have been popular for many years and generally include one or more track sections arranged to form a path around which one or more toy vehicles can travel. Toy vehicles which may be used on such track sets may be either self-powered vehicles or may receive power from an external source.

Accordingly, it is desirable to provide toy track set with features that provide unique paths for the toy vehicles of the toy track to travel on.

SUMMARY OF THE INVENTION

In one embodiment, a toy track set is provided herein, the toy track set having: a vehicle path defined by a track and a gap disposed between a pair of ends of the track; a carriage assembly configured to carry a toy vehicle across the gap such that the toy vehicle may travel from one of the pair of ends of the track to another one of the pair of ends of the track on the carriage assembly; a ferromagnetic material disposed in the track; wherein the toy vehicle has at least one magnet disposed on the toy vehicle such that the toy vehicle may travel on the track in anyone of an inverted or vertical fashion; and a release mechanism positioned on the carriage assembly, the release mechanism being configured to engage one of the pair of ends of the track when the release mechanism is in a first position and release the release mechanism from the one of the pair of ends of the track when the release mechanism is moved to a second position from the first position by the toy vehicle travelling onto the carriage assembly; and wherein the carriage assembly slides along a line from the one of the pair of ends of the track to the other one of the pair of ends of the track when the release mechanism is moved to the second position from the first position by the toy vehicle travelling onto the carriage assembly and wherein the toy vehicle travels from the carriage assembly onto the other one of the pair of ends of the track when the carriage assembly contacts the other one of the pair of ends of the track.

BRIEF DESCRIPTION OF THE DRAWINGS

FIGS. 6A-6F illustrate components of a carriage assembly in accordance with one exemplary embodiment;

DETAILED DESCRIPTION

Figure 1:
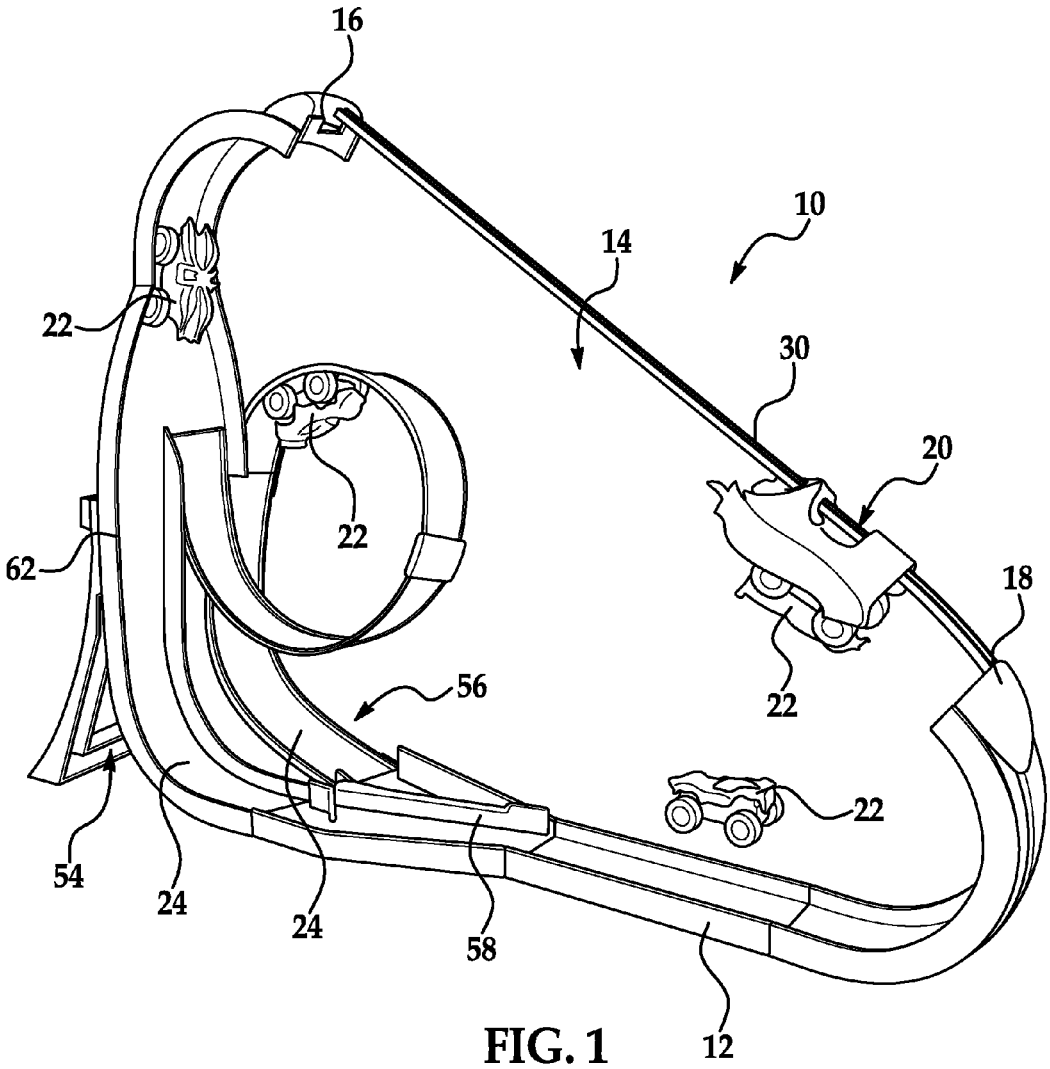
FIG. 1 is a perspective view of a toy track set in accordance with an exemplary embodiment of the present invention.

Reference is made to the following U.S. Pat. Nos. 7,628,673 and 7,549,906 the contents each of which are incorporated herein by reference thereto. Reference is also made to the following U.S. Provisional Patent Application No. 61/377,766 filed Aug. 27, 2010, the contents of which is also incorporated herein by reference thereto.

As illustrated in the FIGS. a toy track set 10 is provided, the toy track set 10 having a vehicle path defined by a track 12 and a gap 14 disposed between a pair of ends 16, 18 of the track.

The toy track set further comprises a carriage or carriage assembly 20 configured to carry a toy vehicle 22 across the gap 14 such that the toy vehicle may travel from one of the pair of ends of the track to another one of the pair of ends of the track on the carriage or carriage assembly 20. In one embodiment, the toy vehicle 22 is self propelled. Motion or propulsion of the toy vehicle may be achieved through a variety of propulsion means. Such toy vehicle propulsion means can include storing energy for propulsion in the vehicle, drawing energy for propulsion from an external power source, or manually propelling the vehicle. Storing energy in a toy vehicle may occur by electrically or mechanically storing energy. For example, energy can be stored electrically by charging a battery on a toy vehicle or energy can be stored mechanically by spinning an inertial flywheel. One non-limiting example of a self propelled toy vehicle is illustrated in U.S. Pat. No. 6,450,857 the contents of which are incorporated herein by reference thereto. A toy vehicle may have different speeds and may change speeds selectively while moving on a toy play set.

In one embodiment, a ferromagnetic material 24 is disposed on or encapsulated in the track or track segments. The toy vehicle also has at least one magnet 26 secured thereto such that when the toy vehicle is in close proximity to the track, the magnet or magnets 26 is/are drawn towards the ferromagnetic material in the track. Accordingly, there is a magnetic attraction between the toy vehicle and the track. This magnetic attraction will allow the toy vehicle to travel on the track in a horizontal manner, in anyone of an upright or inverted manner as well as a vertical fashion. In other words, the magnetic attraction of the magnet to the ferromagnetic material allows the toy vehicle to travel along the track paths in inverted, upright, vertical or other configurations.

The carriage or carriage assembly 20 further comprises a release mechanism 28 positioned on the carriage or carriage assembly 20. The release mechanism is configured to engage one of the pair of ends of the track when the release mechanism is in a first position and the release mechanism is configured to release the release mechanism from the one of the pair of ends of the track when the release mechanism is moved to the second position from the first position. Accordingly, the release mechanism allows the carriage to releasably engage one of the ends of the track. During use of the track set, the release mechanism is moved from the first position to the second position by the toy vehicle as it travels onto the carriage assembly 20 from the track.

When the release mechanism is moved to the second position the carriage assembly 20 is now free to slide along a line or guide 30 from the one of the pair of ends of the track to the other one of the pair of ends of the track. As illustrated in the attached FIGS., the track and the gap is set up so that one of the track ends is higher than the other one of the track ends so that when released, the carriage assembly 20 slides along the line or guide 30 due to gravity forces (e.g., one end of the track is higher than the other). In one embodiment, line 30 may be a wire, string or a more structurally sound element such as an elongated plastic rod or other equivalent material that the carriage assembly 20 may slide along.

Figure 2:
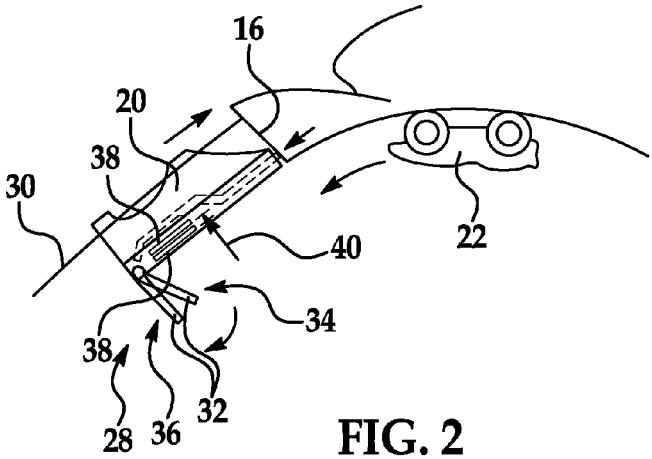
FIG. 2 is a perspective cross-sectional view of a carriage assembly or mechanism for use with an exemplary embodiment of the present invention in a first position.
Figure 3:
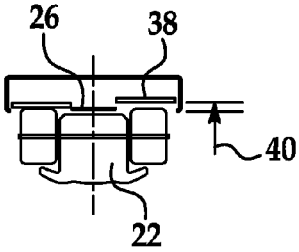
FIG. 3 is a cross sectional view of a carriage assembly or mechanism for use with an exemplary embodiment of the present invention.
Figure 4:
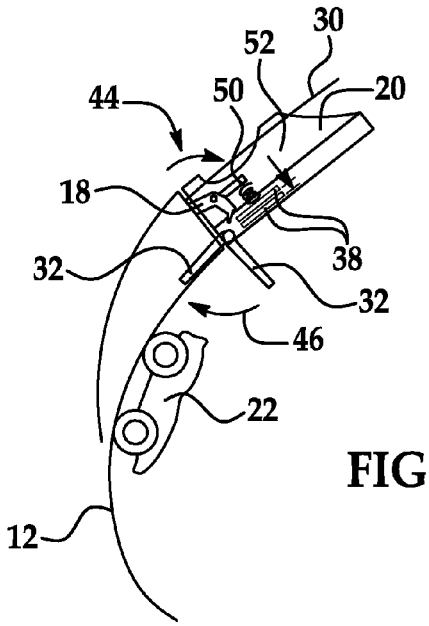
FIG. 4 is a perspective cross-sectional view of a carriage assembly or mechanism for use with an exemplary embodiment of the present invention in a second position.

Referring now to FIGS. 2, 3 and 4, one embodiment of the release mechanism of the carriage assembly 20 is illustrated. In this embodiment, the release mechanism has movable barrier 32 that is moved from a first position 34 to a second position 36 when vehicle 22 is received onto the carriage 20. In the second position 36, the barrier will prevent the vehicle 22 from travelling off of the carriage 20. This movement of the barrier will cause the release mechanism and accordingly the carriage 20 to be released from one of the pair of ends 16 or a first higher end 16 by disengaging a catch secured to the end of the track while also causing a moveable floor portion 38 of the carriage assembly 20 to be moved in the direction of arrows 40 such that at least one drive wheel of the toy vehicle will rotate without engaging the floor portion of the carriage.

Alternatively, floor portion 38 may already be moved in the direction of arrows 40 when the carriage assembly 20 is releasably secured to the higher end 16 and thus the floor portion moves upward in a direction opposite to arrows 40 via spring forces when the carriage assembly 20 makes contact with lower end 18. In other words, the drive wheels of the vehicle will not engage the floor portion of the carriage assembly 20 when it is moved in the direction of arrows 40 regardless of whether this is caused by movement of the vehicle onto the carriage assembly 20 or the securement of the carriage assembly 20 to the higher end of the track. In still another embodiment, the carriage 20 can be configured to engage the vehicle while the wheels of the vehicle still spin and engage or slid along a surface of the carriage 20.

In one embodiment and in order to retain vehicle 22 on the carriage 20, magnet 26 or magnets 26' and 26" of the vehicle engage a ferromagnetic material 42 in the carriage assembly 20 similar to the ferromagnetic material 24 disposed in the track. Alternatively or in addition to the magnetic attraction of the toy vehicle to the carriage 20, the release mechanism may engage a portion of the toy vehicle and retain it on the carriage assembly 20 until it contacts the other end of the gap. In this embodiment, the release mechanism will retain the toy vehicle to the carriage 20 regardless of whether the drive wheels of the toy vehicle are engaging a surface of the carriage 20.

Once the carriage 20 is free or released from the end of the track it will slide along line 30 due to gravity forces and the carriage 20 then contacts and stops at the other one of the pair of ends 18 or a second lower end 18 of the track. When this contact occurs, a trigger 44 (FIG. 4) contacts barrier 32 such that the barrier is moved in the direction of arrow 46 so that the vehicle can travel off of the carriage onto the track. Trigger 44 and movement of the barrier 32 releases the floor portion 38 and a spring biasing force moves the floor portion 38 upward such that the wheels of the toy vehicle can now re-engage the floor portion 38 and drive off of the carriage 20 onto the track. In one non-limiting embodiment, movement of barrier 32 in the direction of arrow 46 causes a compressed spring 50 to be released and the floor portion 38 is pushed in the direction of arrow 52. Thereafter and once the vehicle travels off the carriage 20, the carriage 20 is slid back up guide or line 30 to the high end 16 and the release mechanism 28 is reset such that the carriage assembly 20 re-engages the higher end and in one alternative embodiment the floor portion 38 is moved in the direction of arrows 40 and spring 50 is compressed when the mechanism 28 is reset. Thereafter and as discussed above, when the carriage 20 engages the second lower end the release mechanism releases the toy vehicle and it drives onto the track segment.

Accordingly, the toy vehicle travels from the carriage assembly 20 onto the lower end of the pair of ends of the track when the carriage assembly 20 slides along the line from the higher end of the pair of ends of the track to the lower end of the pair of ends of the track. In one embodiment and due to the magnetic attraction of the toy vehicle to the ferromagnetic material in the carriage assembly 20 the toy vehicle can be received onto the carriage assembly 20 in an inverted manner and the carriage itself is secured to the track set such that it may travel in an inverted manner.

Figure 5:
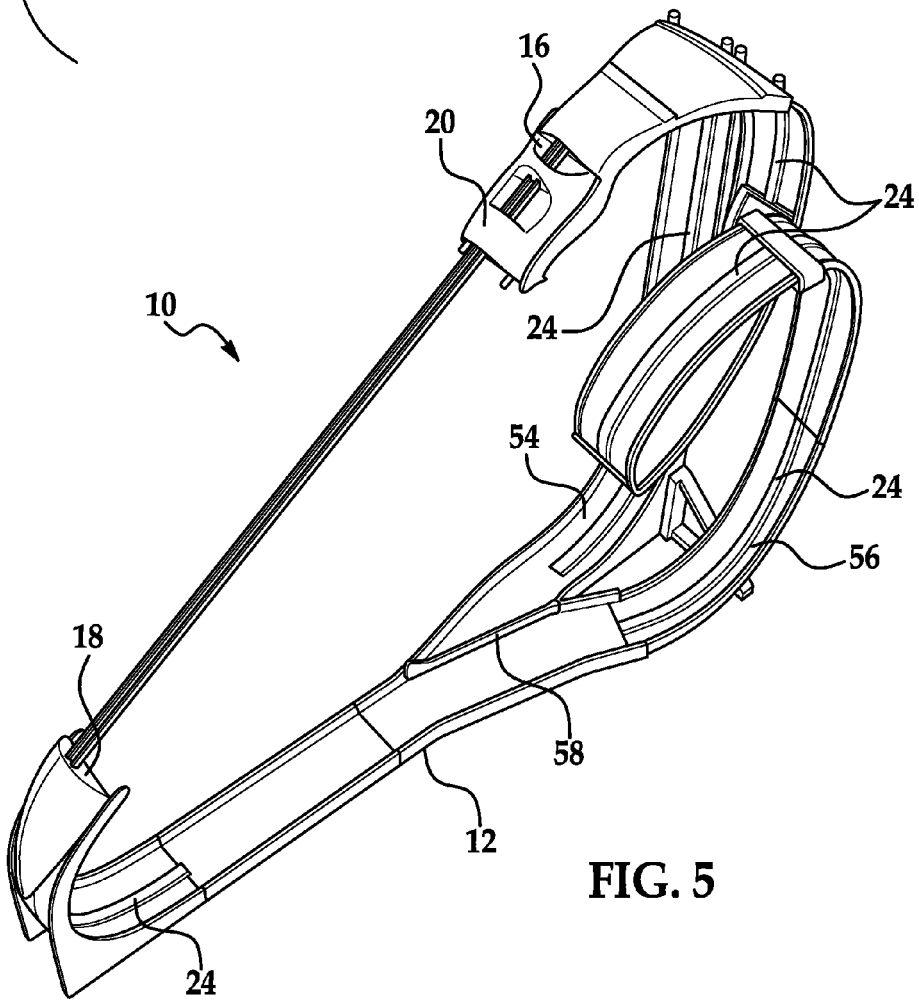
FIG. 5 is perspective view of an alternative exemplary embodiment of the present invention.

As illustrated in FIG. 1, the track may have two alternative paths 54 and 56 separated from each other by a moveable diverter 58 pivotally mounted to the track set. The diverter 58 allows the user to select either one of the alternative paths 54 and 56 by moving the diverter so that the toy vehicle is diverted onto a different path. As illustrated, track path 54 includes a loop section 60 while track 54 includes a vertical section 62 each section allowing the vehicle to travel thereon due to the magnet or magnets of the toy vehicle being attracted to the ferromagnetic materials 24 in the tracks. Thereafter, both paths merge together on the portion of the track that terminates at the end 16. FIG. 5 illustrates an alternative track set 10 configuration.

Referring now to FIGS. 6A-9D another non-limiting embodiment of the carriage or carriage assembly 20 is illustrated. As discussed above, carriage or carriage assembly 20 is configured to releasably engage end 16 of the track 12 when the carriage 20 is abutted thereto. Once the toy vehicle 22 travels on to the carriage 20 from end 16 the carriage 20 is disengaged from end 16 and the carriage 20 slides down line 30 towards end 18 while traversing gap 14.

As illustrated in FIGS. 6A-9D, the carriage 20 has a housing portion 70 with an opening 72 configured to slidably receive line or wire 30 therein and so that the carriage may travel in an inverted or upside down position on line or wire 30. In order to releasably engage end 16 of the track 12, a releasable catch 74 is pivotally secured to the housing portion 70 of the carriage 20 through a pair of pin members 76 about an axis 78 such that pivotal movement of releasable catch between a first position and a second position is possible. Releasable catch 74 has a first end portion 80 configured to releasably engage end 16 of the track 12 when the carriage 20 is abutted thereto and when the vehicle 22 is not on the carriage 20. In one embodiment first end portion 80 has a feature 81 configured to engage a feature 83 of the track end 16 (see at least FIG. 7). Releasable catch 74 also has a second end portion 82 configured to contact end 18 of the track after the carriage 20 traverses gap 14.

In order to engage end 16 of the track 12 the releasable catch 74 is biased in the direction of arrow 84 by a spring 86 which causes feature 81 of end 80 to engage a portion or feature 83 of end 16 of the track.

Releasable catch 74 also has a magnet 88 and a pair of features 90 secured thereto proximate to end portion 82. Features 90 are configured to engage a forward portion of the vehicle when it is received on the carriage 20 and magnet 88 is located below features 90 to facilitate movement of the releasable catch 74 and ultimately the releasable carriage 20 when the vehicle travels onto the same. When the releasable carriage 20 is secured to the end 16 via features 81 of end 80 and when vehicle 22 travels onto carriage 20, end 80 is released from end 16 due to the magnetic attraction of magnet 88 to magnets 26' and 26" located on the vehicle. (See for example FIG. 7D). In this embodiment, the vehicle will have a forward magnet 26' and a rearward magnet 26". It being understood that the forward magnet 26' is simply the first magnet of the vehicle 22 to travel onto the carriage 20.

Figure 9B:
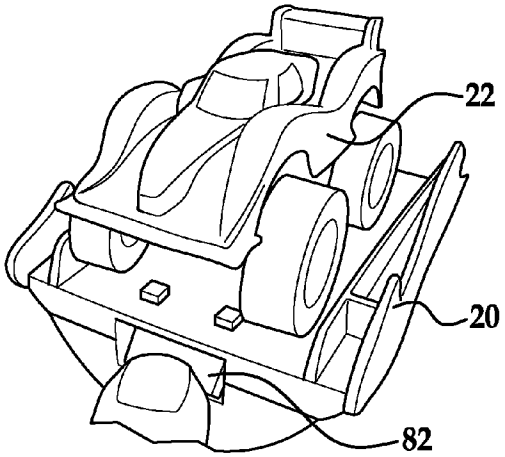
FIGS. 9A-9D are views illustrating the vehicle on the carriage and movement of the release mechanism of the carriage.
Figure 9D:
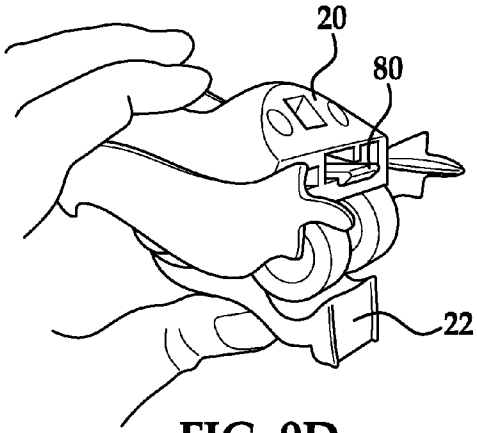
Figure 9A:
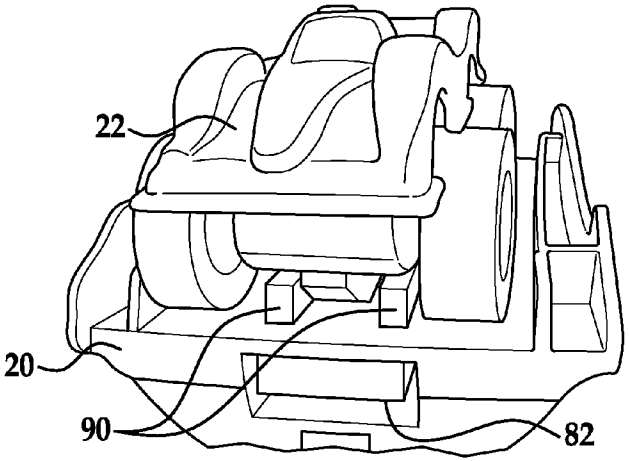
Figure 9C:
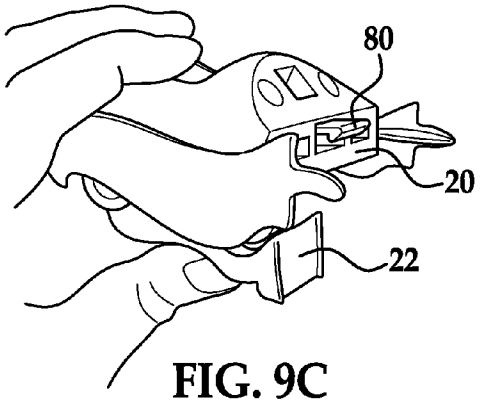

In addition, and as magnet 88 is attracted to magnet 26' features 90 coupled to the releasable catch 74 rise up from a cavity in the carriage 20 such that they are in a blocking configuration which prevents vehicle 22 from traveling completely off of carriage 20 (see at least FIG. 9A). This movement is due to the pivotal securement of the releasable catch 74 to the housing 70 and the magnetic attraction of magnets 26' and 88.

Figure 7A:
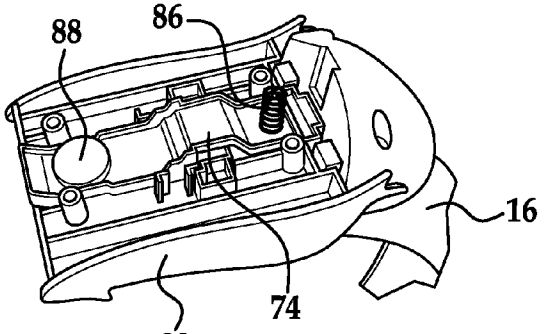
FIGS. 7-8D illustrate components and movement of the carriage assembly and the track set in accordance with one exemplary embodiment.
Figure 7B:
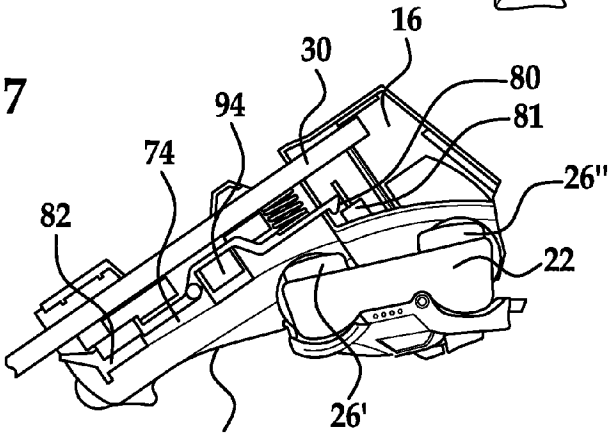
Figure 7D:
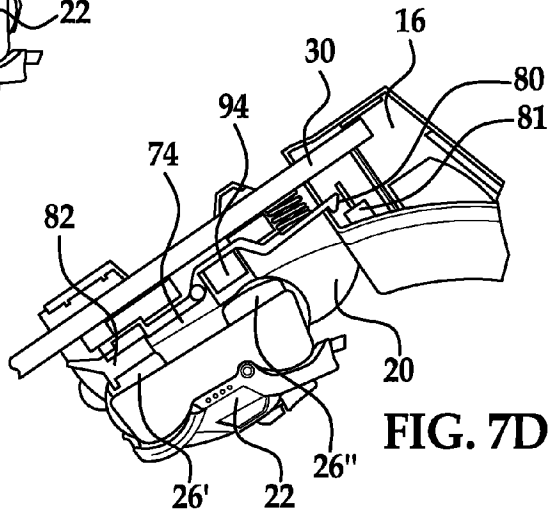
Figure 7:
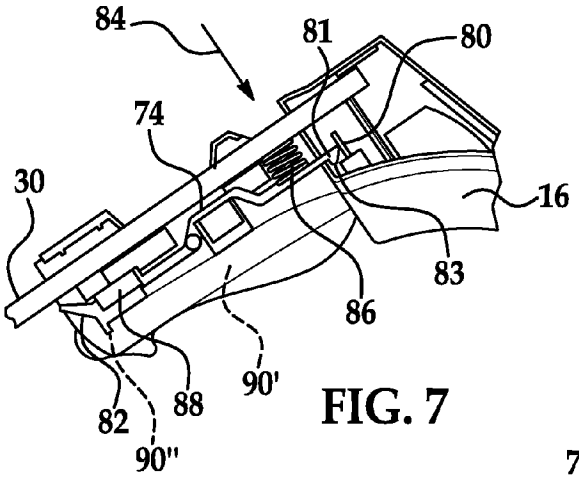
Figure 7C:
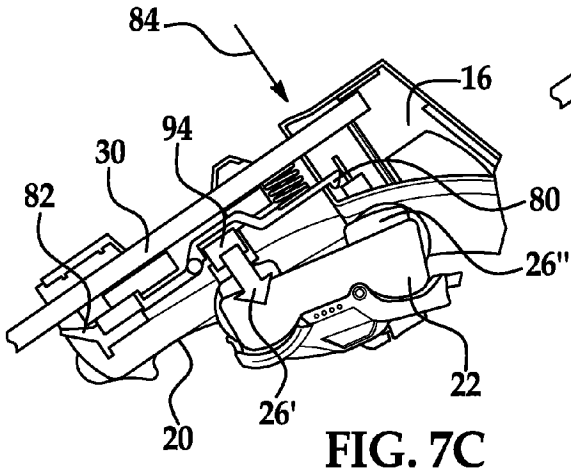
Figure 8B:
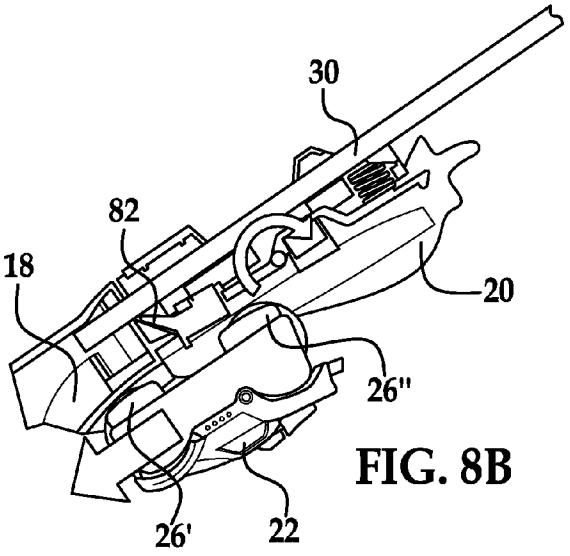
Figure 8A:
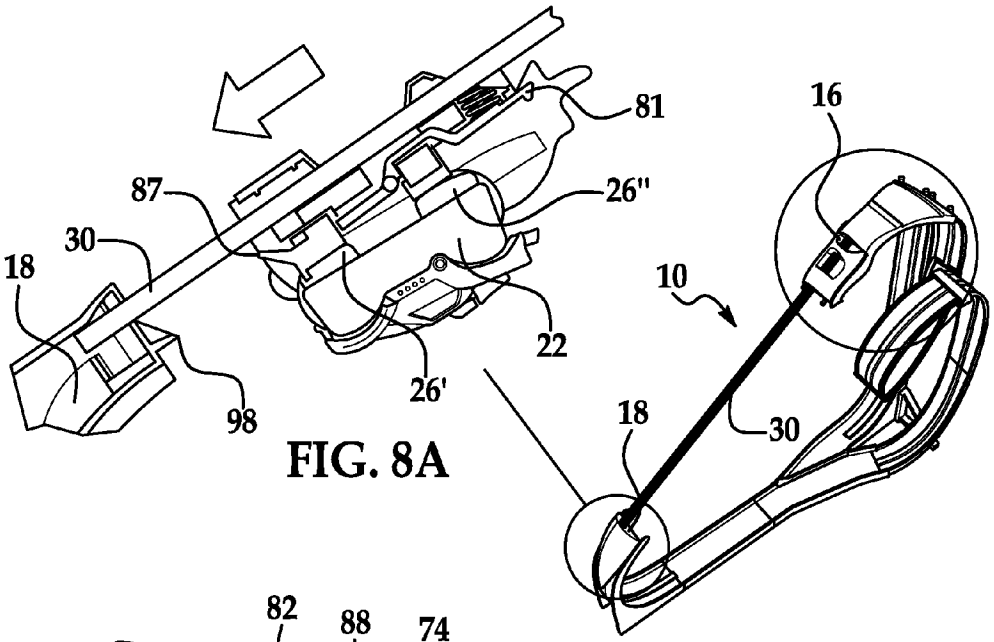
Figure 8D:
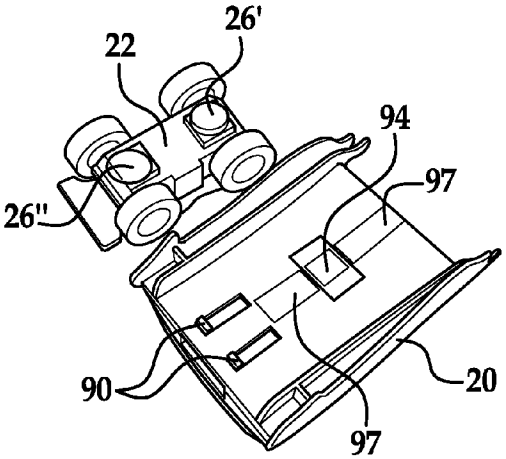
Figure 8C:
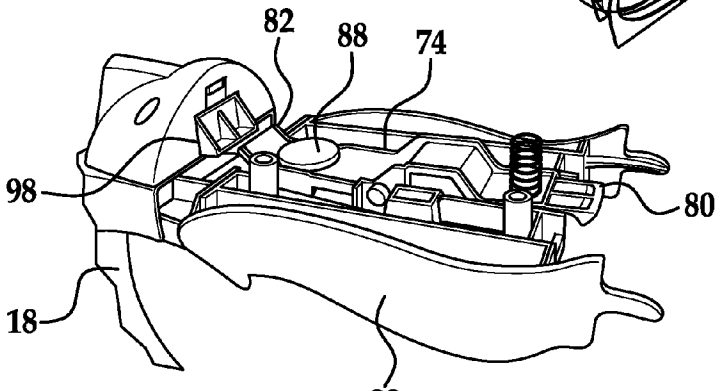

In addition, another movable member 94 is movably received within an opening 95 of the carriage 20 such that as the vehicle travels from end 16 onto carriage 20, movable member 94 is attracted to one of a pair of magnets 26' and 26" disposed on vehicle 22. This attraction is caused by a ferromagnetic material disposed on a surface of movable member 94. Accordingly and as illustrated in FIG. 7C, movable member 94 is attracted to the vehicle which keeps the vehicle stable with respect to carriage 20 until the forward magnet 26' is in a position to magnetically attract magnet 88 and cause end 80 of the releasable catch to be biased in a direction opposite to arrow 84 such that the same can be disengaged from end 16 of the track (FIG. 7D). When the vehicle is in this position a rearward magnet 26" attracts movable member 94 to the vehicle to ensure that it is stable with respect to the carriage 20. In this position or when the vehicle is fully received on the carriage 20 the forward magnet 26' pulls magnet 88 towards the vehicle so that end 80 is disengaged from end 16 and a rearward magnet of the vehicle pulls movable member 94 towards a vehicle such that the vehicle is retained on carriage 20 and carriage 20 is now released from end 16 such that it can now slide down line 30 towards end 18 of the track. Of course, carriage 20 can be constructed without moveable member 94.

Still further and to provide additional stability and in order to ensure that the vehicle 22 is retained on the releasable carriage 20, ferromagnetic materials 97 can be disposed on the surface of the carriage on either side of opening 95 to attract the vehicle in similar fashion as on the track paths. Of course, the carriage 20 can be constructed without ferromagnetic materials 97 or such materials may only be disposed on moveable member 94.

Once the carriage 20 is released by the vehicle 22 travelling thereon and the carriage 20 and the vehicle 22 traverses the gap 14 and arrives at end 18, the forward end 82 of the releasable catch 74, which is configured to have a chamfered surface 87, engages an angled or chamfered surface 98 of end 18. Once the chamfered surface 87 of the forward end 82 engages surface 98, magnet 88 and features 90 are moved away from the forward magnet 26' of the vehicle since the contact of surfaces 87 and 98 will move the releasable catch 74 away from magnet 26' by overcoming the magnetic attraction therebetween. Once this occurs, the vehicle 22 can now travel from carriage 20 onto the track 12 proximate to end 18 since vehicle 22 is self-propelled and was is in essence, being held in check by features 90, which are no longer in a blocking position due to the contact of surfaces 87 and 98. Thereafter, the vehicle 22 travels onto the track 12 proximate to end 18.

Accordingly, carriage 20 is configured to releasably engage end 16 of the track through an end 80 of releasable catch 74 that is spring biased into a first or an engagement position. The pivotal securement of the releasable catch 74 allows it to move away from feature 83 of end 16 and then the biasing force causes a feature 81 of end 80 to engage end 16 and secure the carriage 20 thereto. Once secured to end 16, carriage 20 is configured to receive a vehicle 22 from track 12. As vehicle 22 travels onto the carriage 20 from the track a forward or first magnet 26' of the vehicle causes movable member 94 movably secured to the carriage 20 to move upward from a surface of the carriage 20 in order to provide stability to the vehicle as it travels onto the surface of the carriage 20.

Thereafter and as the vehicle completely travels onto the surface of the carriage 20, the first magnet 26' engages or attracts a magnet 88 secured a portion of the releasable catch such that the same is moved towards the vehicle and a pair of stop features 90 are pulled upward from a surface of the carriage 20 such that they are located in a blocking position in order to prevent the vehicle from completely traveling off of the carriage 20 since, in one embodiment, the vehicle is self propelled by a flywheel and features 90 are necessary to hold it onto the carriage 20 as it traverses gap 14. Still further and when the vehicle is in this position, a second or rearward magnet 26" of the vehicle attracts movable member 94 to the vehicle in order to stabilize and secure it to the carriage (similar to the first or forward magnet 26") as it slides down line 30 towards end 18 since the movement of magnet 88 towards the first or forward magnet 26' of the vehicle causes end 82 to become disengaged from end 16 of the track and thus allow the carriage 20 to slide down line 30 towards end 18 of the track (e.g., movement of the releasable catch from the first position to the second position).

Thereafter and once the carriage 20 makes contact with end 18, end 82 of the carriage 20 is moved away from the vehicle due to the engagement of feature or surface 98 and the chamfered surface 87 of end 82 of releasable catch 74 and accordingly stop features 90 are pulled into the surface of the carriage 20 such that the vehicle now can self propel itself away from the carriage onto track 18 (e.g., movement of the releasable catch from the second position to the first position). Thereafter, the carriage 20 is ready to be slid back towards end 16 so that it can engage the same and be ready to receive vehicle 22 as it travels on track 12 towards end 16 or alternatively receive another vehicle 22 from end 16 of the track (e.g., multiple vehicles).

In yet another alternative embodiment, the release mechanism 28 is configured such that the releasable catch 74 is configured to have a pair of members each being pivotally secured to the housing 70 and each cooperating with each other on one end while the other end has one of feature 81 and surface 87. In addition and in this embodiment, stop features 90 are located on both pairs of members such that as the vehicle 22 travels onto the carriage and the release mechanism is in the first position the vehicle will contact stop features 90 coupled to the one of the pair of members having feature 81. In other words, a pair of stop features 90' and 90" is provided. These features are illustrated as dashed lines in FIG. 7. In this embodiment, the first pair of stop features 90' are deployed from the surface of the carriage 20 when feature 81 engages end 16 of the track. Here the vehicle contacts the features 90' and this contact causes feature 81 to release the carriage from the track end 16. However, a second feature 90" further along on the surface of the carriage is coupled to surface 87 and is also in a deployed position such that this feature 90" prevents the vehicle from travelling off of the carriage until the carriage has arrived at the end 18 of the track. When surface 87 engages surface 98 of track end 18, this feature 90" is moved into a stowed position and the vehicle can now travel off of the carriage onto the track. In still another alternative, surface 87 may be coupled to both pairs of features 90' and 90" such that when surface 87 engages surface 98 of track end 18, both pairs of features 90' and 90" are moved into a stowed position and the vehicle can now travel off of the carriage onto the track.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A toy track set, comprising:

a vehicle path defined by a track and a gap disposed between a pair of ends of the track;

a carriage assembly configured to carry a toy vehicle across the gap such that the toy vehicle may travel from one of the pair of ends of the track to another one of the pair of ends of the track on the carriage assembly;

a ferromagnetic material disposed in the track; and wherein the toy vehicle has at least one magnet disposed on the toy vehicle such that the toy vehicle may travel on the track in any one of an inverted or vertical fashion; and a release mechanism positioned on the carriage assembly, the release mechanism being configured to engage one of the pair of ends of the track when the release mechanism is in a first position and release the release mechanism from the one of the pair of ends of the track when the release mechanism is moved to a second position from the first position by the toy vehicle travelling onto the carriage assembly;

wherein the carriage assembly slides along a line from the one of the pair of ends of the track to the other one of the pair of ends of the track when the release mechanism is moved to the second position from the first position by the toy vehicle travelling onto the carriage assembly and wherein the toy vehicle travels from the carriage assembly onto the other one of the pair of ends of the track when the carriage assembly contacts the other one of the pair of ends of the track, and wherein the toy vehicle is received onto the carriage assembly in an inverted manner.

2. The toy track set as in claim 1, wherein the toy vehicle is retained on the carriage assembly in the inverted manner by the at least one magnet disposed on the toy vehicle.

3. The toy track set as in claim 2, wherein the carriage assembly has a movable floor portion that moves away from a drive wheel of the toy vehicle when the toy vehicle is received on the carriage assembly and the release mechanism is moved to the second position from the first position by the toy vehicle travelling onto the carriage assembly.

4. The toy track set as in claim 1, wherein the one of the pair of ends of the track is higher than the other one of the pair of ends of the track.

5. The toy track set as in claim 1, wherein the release mechanism further comprises a releasable catch pivotally mounted to the carriage assembly for movement between the first position and the second position.

6. The toy track set as in claim 5, wherein the releasable catch has a first end having a feature configured to releasably engage a feature of one of the pair of ends of the track that is higher than the other one of the pair of ends of the track when the releasable catch is in the first position and wherein the releasable catch has a second end with a chamfered surface configured to engage a feature of the other one of the pair of ends of the track.

7. The toy track set as in claim 6, wherein the releasable catch is spring biased into the first position.

8. The toy track set as in claim 6, wherein the releasable catch further comprises features configured to move from a stowed position when the releasable catch is in the first position to a deployed position when the releasable catch is in the second position and wherein the features prevent the toy vehicle from travelling off of the carriage assembly when the releasable catch is in the second position.

9. The toy track set as in claim 8, wherein the releasable catch further comprises a magnet configured to move the releasable catch from the first position to the second position when the toy vehicle is positioned on the carriage assembly.

10. The toy track set as in claim 9, wherein the toy vehicle is received onto the carriage assembly in an inverted manner and wherein the toy vehicle is retained on the carriage assembly in the inverted manner by the at least one magnet disposed on the toy vehicle.

11. The toy track set as in claim 10, wherein the releasable catch is spring biased into the first position.

12. The toy track set as in claim 10, wherein the vehicle path includes a loop portion and a vertical portion each leading to the one of the pair of ends of the track that is higher than the other one of the pair of ends of the track and wherein a diverter for selecting either the loop or the vertical portion is located on the track.

13. The toy track set as in claim 11, wherein the carriage assembly further comprises a movable member that is magnetically attracted to the toy vehicle when the toy vehicle is received on the carriage assembly.

14. The toy track set as in claim 6, wherein the releasable catch is moved to the second position when the chamfered surface of the second end engages the feature of the other one of the pair of ends of the track.

15. The toy track set as in claim 14, wherein the toy vehicle is self propelled.

16. The toy track set as in claim 6, wherein the carriage assembly further comprises a ferromagnetic material for retaining the toy vehicle on the carriage assembly in an inverted manner and wherein the toy vehicle is retained on the carriage assembly in the inverted manner by the at least one magnet disposed on the toy vehicle.

17. In combination, a carriage assembly and a self propelled toy vehicle with at least one magnet secured thereto, wherein the carriage assembly comprises:

a releasable catch pivotally mounted to a housing of the carriage assembly for movement between a first position and a second position, wherein the releasable catch has a first end and a second end each being moved as the releasable catch moves between the first position and second position;

a magnet secured to the releasable catch; and features configured to move from a stowed position with respect to a surface of the housing of the carriage assembly when the releasable catch is in the first position to a deployed position when the releasable catch is in the second position and wherein the features prevent the toy vehicle from travelling off of the carriage assembly when the releasable catch is in the second position; and wherein the at least one magnet of the toy vehicle moves the releasable catch from the first position to the second position as the toy vehicle travels onto the surface of the housing of the carriage assembly.

18. The carriage assembly and toy vehicle of claim 17, wherein the surface of the housing further comprises a ferromagnetic material for retaining the toy vehicle on the carriage assembly in an inverted manner and wherein the toy vehicle is retained on the carriage assembly in the inverted manner by the at least one magnet of the toy vehicle.

19. The carriage assembly and toy vehicle of claim 18, wherein the carriage assembly further comprises a movable member that is magnetically attracted to the toy vehicle when the toy vehicle is received on the carriage assembly and wherein the releasable catch is spring biased into the first position.

* * * * *